US009977399B2

(12) United States Patent
Kobayashi

(10) Patent No.: US 9,977,399 B2
(45) Date of Patent: May 22, 2018

(54) IMAGE FORMING APPARATUS CONTROLLED BASED ON ENVIRONMENTAL CONDITIONS

(71) Applicant: CANON FINETECH NISCA INC., Saitama (JP)

(72) Inventor: Masato Kobayashi, Kashiwa-shi (JP)

(73) Assignee: Canon Finetech Nisca Inc., Misato-shi (JP)

( * ) Notice: Subject to any disclaimer, the term of this patent is extended or adjusted under 35 U.S.C. 154(b) by 21 days.

(21) Appl. No.: 14/722,407

(22) Filed: May 27, 2015

(65) Prior Publication Data

US 2015/0346683 A1 Dec. 3, 2015

(30) Foreign Application Priority Data

May 30, 2014 (JP) ..... 2014-112731
May 19, 2015 (JP) ..... 2015-101487

(51) Int. Cl.
*G03G 15/16* (2006.01)
*G03G 21/20* (2006.01)

(52) U.S. Cl.
CPC ..... *G03G 21/20* (2013.01); *G03G 15/1675* (2013.01); *G03G 15/1645* (2013.01); *G03G 21/203* (2013.01)

(58) Field of Classification Search
CPC ..... G03G 15/1645; G03G 15/1675; G03G 21/20; G03G 21/203
USPC ..... 399/31, 44, 66, 94, 97
See application file for complete search history.

(56) References Cited

U.S. PATENT DOCUMENTS

2012/0189330 A1* 7/2012 Kunimatsu ..... G03G 15/657 399/44
2012/0243892 A1* 9/2012 Nakamura ..... G03G 15/1675 399/66

FOREIGN PATENT DOCUMENTS

JP 5-88434 A 4/1993
JP 10-097147 A 4/1998
JP 2000-330401 A 11/2000
JP 2010-48960 A 3/2010

OTHER PUBLICATIONS

Office Action dated Feb. 13, 2018, in Japanese Patent Application No. 2015-101487.

* cited by examiner

*Primary Examiner* — Joseph S Wong
(74) *Attorney, Agent, or Firm* — Fitzpatrick, Cella, Harper & Scinto

(57) ABSTRACT

An image forming apparatus which forms an image on a recording material includes a transfer unit which transfers a toner image formed on an image bearing member to a recording medium, an applying unit which applies a predetermined current or voltage to the transfer unit, a detection unit which detects a voltage value with respect to the predetermined current applied by the applying unit or a current value with respect to the predetermined voltage applied by the applying unit, an environment detection sensor which detects an environment, and a determination unit which compares a detection result of the detection unit with a predetermined value according to a detection result of the environment detection sensor to determine whether or not predetermined discharge occurs in the transfer unit.

11 Claims, 6 Drawing Sheets

FIG. 4

| | TEMPERATURE | 15°C | 7.5°C | CHANGING FROM 7.5°C TO 15°C |
|---|---|---|---|---|
| | ABNORMAL DISCHARGE | NOT | OCCURRENCE | OCCURRENCE |
| APPARATUS ACCORDING TO EMBODIMENT | | NO ABNORMALITY | ALTHOUGH PARTIALLY SLIGHT DETERIORATION IN IMAGE QUALITY IS OBSERVED, THERE IS ALMOST NO ABNORMALITY | AUTOMATIC IMPROVEMENT OF IMAGE QUALITY |
| EXAMPLE 1 IN THE RELATED ART | | NO ABNORMALITY | ABNORMAL IMAGE AND DAMAGE TO APPARATUS | ABNORMAL IMAGE AND DAMAGE TO APPARATUS |
| EXAMPLE 2 IN THE RELATED ART | | DETERIORATION IN IMAGE QUALITY | NO ABNORMALITY | DETERIORATION IN IMAGE QUALITY |
| EXAMPLE 3 IN THE RELATED ART | | DETERIORATION IN IMAGE QUALITY | DETERIORATION IN IMAGE QUALITY | DETERIORATION IN IMAGE QUALITY |
| EXAMPLE 4 IN THE RELATED ART | | NO ABNORMALITY ACCORDING TO SERVICE MAN'S SETTING | NO ABNORMALITY ACCORDING TO SERVICE MAN'S SETTING | IF THERE IS NO APPROPRIATE SERVICE MAN'S SETTING, THERE IS DETERIORATION IN IMAGE QUALITY |

*FIG. 5*

| | | LEAKAGE OCCURRENCE THRESHOLD VOLTAGE (V) | | |
|---|---|---|---|---|
| | | L/L | N/N | H/H |
| APPLIED CONSTANT CURRENT VALUE (μA) | 5 μA | 3300 | 1600 | 860 |
| | 4 μA | 2700 | 1200 | 620 |
| | 3 μA | 2200 | 900 | 490 |

IMAGE FORMING APPARATUS CONTROLLED BASED ON ENVIRONMENTAL CONDITIONS

BACKGROUND OF THE INVENTION

Field of the Invention

The present invention relates to an image forming apparatus which performs a transfer output control at the time of forming an image.

Description of the Related Art

In recent years, in an image forming apparatus, for example, a copying machine or a laser beam printer, in order to obtain a high quality image even in a case where the environment of the installation site thereof is changed, various controls have been performed in the image forming process. For example, in a case where a high voltage is applied to an image forming component, abnormal discharge may occur according to the environment (temperature and humidity). Since the occurrence of the abnormal discharge greatly influences good or bad image quality, the occurrence of the abnormal discharge is prevented by changing the image forming condition according to the above-described factors.

As the control performed in the related art, there is ATVC (Active Transfer Voltage Control) of applying a constant current to a transfer roller which is to be applied with a high voltage before image formation and performing application of a constant voltage at the time of image formation by using a voltage value applied to the constant current circuit. This control copes with a change in resistance of the transfer roller according to a change of the environment.

However, this control method does not cope with a change in atmospheric pressure. Therefore, for example, when the apparatus is used at a high-altitude area where the atmospheric pressure is low, the image may be abnormal. When high voltages are applied to a transfer unit and a separation charge removal unit having different application polarity at a high altitude based on only the environment condition of temperature and humidity, leakage as abnormal discharge occurs between the two components (in a gap). Accordingly, deterioration in image quality occurs due to a shortage of a transfer current or the like, or damage to an electric element on a board occurs due to a flow of an excessive current according to the leakage.

The relationship between a leakage occurrence voltage and atmospheric pressure is known as the Paschen's law. In a case where the gap is maintained constant, a discharge starting voltage is decreased as the atmospheric pressure becomes low, and the abnormal discharge such as leakage easily occurs as the altitude become high.

With respect to the abnormal discharge, for example, Japanese Patent Laid-Open No. 5-88434 discloses an apparatus where an atmospheric pressure detection sensor is provided to an image forming apparatus and a control device changes an image forming condition according to an output of the sensor.

In addition, Japanese Patent Laid-Open No. 2010-48960 discloses an apparatus where, without providing an atmospheric pressure detection sensor, a dedicated leakage detection circuit which detects a leakage current occurring at the time of applying a high voltage is provided to a high-voltage applying unit which applies a high voltage to a transfer unit to detect the leakage current occurring in the state where the atmospheric pressure is low and to change an image forming condition.

However, in the image forming apparatus disclosed in Japanese Patent Laid-Open No. 5-88434, an atmospheric pressure sensor needs to be newly installed. In addition, even in the atmospheric pressure condition that the leakage easily occurs due to a low atmospheric pressure, under a high-temperature high-humidity environment condition where a resistance value of an object which a high voltage is to be applied is decreased, the voltage may not reach the leakage occurrence voltage. Even in a case where there is no need to decrease the applied voltage, the control of decreasing the applied voltage is performed based on only the atmospheric pressure condition, so that deterioration in image quality may occur due to a shortage of the transfer current.

In addition, in the image forming apparatus disclosed in Japanese Patent Laid-Open No. 2010-48960, since the leakage detection circuit is configured by arranging dedicated patterns for leakage detection with slight narrow spacing in high-voltage output lines in a high-voltage power supply board, it is not possible to accurately detect whether or not the leakage occurs between image forming components where the leakage actually occurs.

SUMMARY OF THE INVENTION

The invention is to provide an image forming apparatus capable of determining occurrence of abnormal discharge occurring in a transfer unit in view of above-described problem.

According to an aspect of the invention, there is provided an image forming apparatus which forms an image on a recording material, including a transfer unit which transfers a toner image formed on an image bearing member to a recording medium, an applying unit which applies a predetermined current or voltage to the transfer unit, a detection unit which detects a voltage value with respect to the predetermined current applied by the applying unit or a current value with respect to the predetermined voltage applied by the applying unit, an environment detection sensor which detects an environment, and a determination unit which compares a detection result of the detection unit with a predetermined value according to a detection result of the environment detection sensor to determine whether or not predetermined discharge occurs in the transfer unit.

According to the invention, it is possible to accurately determine whether or not the abnormal discharge occurs in a transfer portion. In addition, by determining an applied voltage or current at the time of image formation according to the above determination, it is possible to avoid an abnormal image or damage to an electric element.

Further features of the present invention will become apparent from the following description of exemplary embodiments with reference to the attached drawings.

BRIEF DESCRIPTION OF THE DRAWINGS

FIG. 4 is a table listing effects of a case where the embodiment is performed, a case where the embodiment is not performed, and examples in the related art; and FIG. 5 is a table of leakage occurrence threshold voltages for illustrating an example of the embodiment of the invention.

DESCRIPTION OF THE EMBODIMENTS (Configuration of Image Forming Apparatus)

Figure 1:
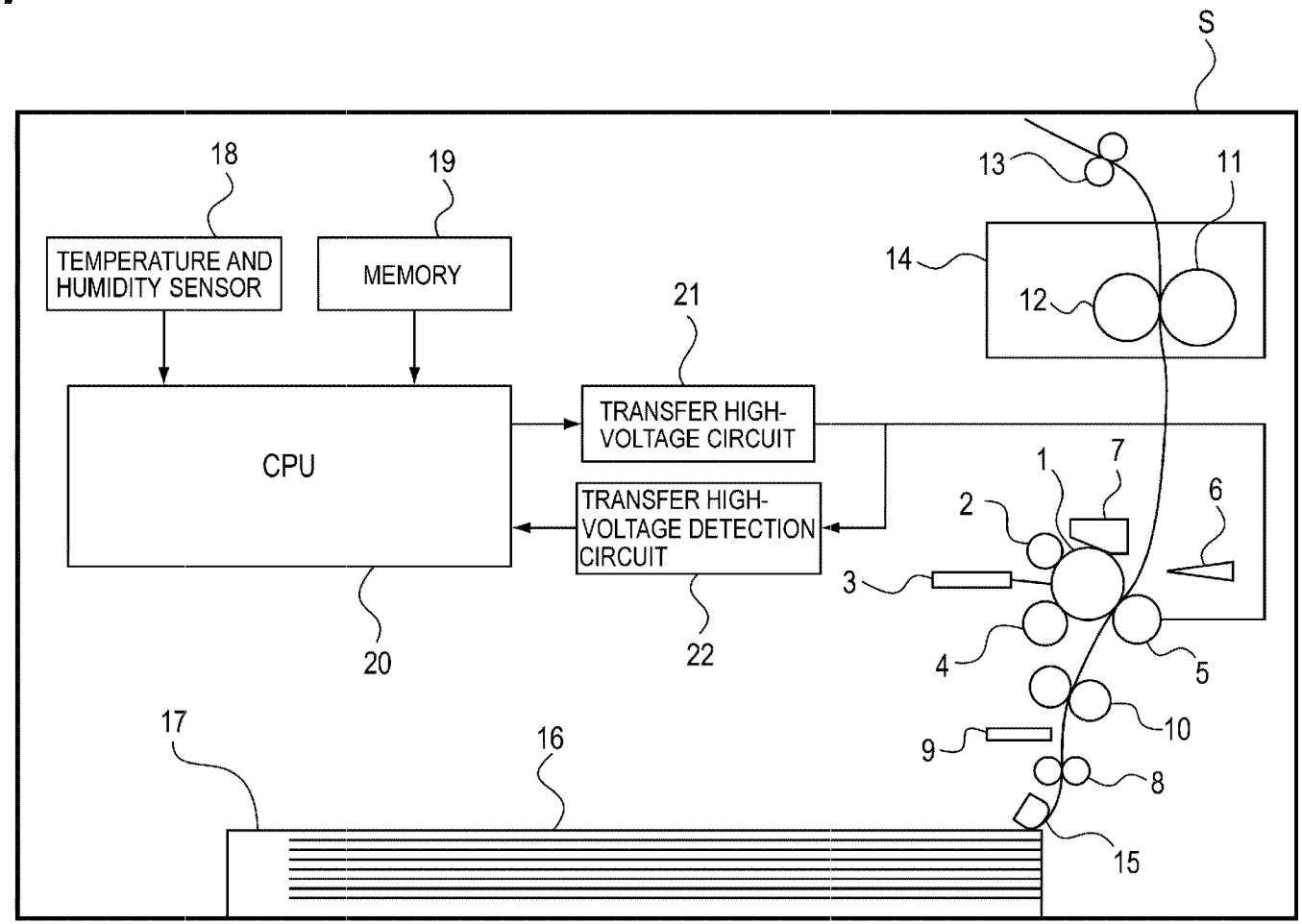
FIG. 1 is a schematic diagram illustrating an image forming apparatus according to a first embodiment.

FIG. 1 is a schematic diagram illustrating an image forming apparatus S according to a first embodiment. Hereinafter, the image forming apparatus S will be described along a conveying path of a recording medium.

A sheet cassette 17 contains a sheet 16 which is a recording medium. The sheet 16 is conveyed to a pair of conveying rollers 8 by rotation of a feed roller 15. The sheet 16 passing between the pair of conveying rollers 8 is further conveyed to a pair of registration rollers 10. The pair of registration rollers 10 conveys the sheet 16 to a nip between a transfer roller 5 which is a transfer unit and a photosensitive drum 1. The nip is a portion which transfers a toner image formed on the photosensitive drum 1 which is an image bearing member having a photoconductive layer such as an OPC or an a-Si to the sheet 16 and is called a transfer nip.

In the formation of the toner image on the photosensitive drum 1, after the surface of the photosensitive drum 1 is uniformly charged by a charging device 2, a latent image is formed on the surface of the photosensitive drum 1 through exposing according to image information by an exposing device 3. The formed latent image is attached to a developer (toner) to be developed by a developing device 4.

A toner image formed on the photosensitive drum 1 is applied with electric charges (transfer bias) having a polarity opposite to that of the toner from the rear side of the sheet 16 by the transfer roller 5 so as for the toner image on the photosensitive drum 1 to be adsorbed to the sheet 16, so that the toner image is transferred to the sheet 16. On the other hand, the residual toner which is not transferred to the sheet 16 and remains on the photosensitive drum 1 is removed from the surface of the photoconductor drum by a cleaner 7.

The sheet 16 to which the toner image is transferred is neutralized by a separation charge removal needle 6 in order to allow the sheet to be easily separated from the photosensitive drum 1, so that the sheet is separated from the photosensitive drum 1. In the state where a non-fixed toner image is borne on the surface of the sheet, the sheet 16 separated from the photosensitive drum 1 is conveyed to a fixing nip between a pressure roller 11 and a fixing film 12 constituting a fixing device 14. In the fixing device 14, the toner image is fixed on the sheet 16. After that, the sheet 16 is discharged outside from the image forming apparatus S by a discharge roller 13.

Next, transferring of the toner to the sheet 16 will be described in detail.

The toner image developed on the photosensitive drum 1 is moved to the transfer nip where the photosensitive drum 1 and the transfer roller 5 face each other by the rotation of the photosensitive drum 1. At the timing when the sheet 16 is conveyed to the transfer nip by the pair of registration rollers 10, a DC voltage having a polarity opposite to that of the developer is applied from a transfer high-voltage circuit 21, which is an applying unit, of the high-voltage power supply unit to the transfer roller 5. In addition, the transfer high-voltage circuit 21 includes a constant current circuit and a constant voltage circuit to apply a plus DC voltage having a polarity opposite to that of the toner according to the embodiment to the transfer roller 5 during the image formation. As a result, the toner image attached on the photosensitive drum 1 is sequentially electrostatically transferred to the sheet 16.

As illustrated in FIG. 1, a controller is configured to include a CPU 20 which executes processes of the respective units of the image forming apparatus S according to a program and a memory 19 including a ROM which stores the program executed by the CPU 20 or data, a RAM used as a work area, and the like. Voltage application from the transfer high-voltage circuit 21 to the transfer roller 5 is performed by allowing the CPU 20 to instruct the transfer high-voltage circuit 21 to perform voltage application based on information obtained from a temperature humidity sensor 18 which is an environment detection sensor and a memory 19. A transfer high-voltage detection circuit 22, which is a detection unit, detects the voltage supplied by the transfer high-voltage circuit 21. The CPU 20 obtains a transfer voltage between the transfer roller 5 and the photosensitive drum 1 based on a detection result of the transfer high-voltage detection circuit 22 according to a predetermined algorithm.

In addition, in the embodiment, a contact transfer roller method where the transfer roller is in contact with the photosensitive drum 1 is used. Besides, an intermediate transfer belt method where the toner image is transferred to a transfer belt and, after that, the toner image is further transferred to the sheet 16 may be used.

In addition, in the embodiment, an abnormal discharge (predetermined discharge) phenomenon where air insulation between two members which are in contact with each other or separated by a predetermined distance from each other is destructed so as to allow a leakage current to be flowed is simply called "leakage".

(Transfer Roller)

Next, the transfer roller 5 as a transfer member which is a transfer unit according to the embodiment will be described.

In the embodiment, the contact transfer roller method where the transfer roller is in contact with the photosensitive drum 1 is used. However, a transfer roller having a single-layer structure is used as the transfer roller 5. The transfer roller 5 is an ion conductive rubber roller configured with mainly a metal shaft body and a conductive foamed body layer made of a sponge rubber obtained by foaming a mixed rubber of an acrylonitrile butadiene rubber (NBR) and a hydrin rubber in an outer circumference thereof.

The metal shaft body constituting the transfer roller 5 is not particularly limited, but a core made of a solid body made of a metal, a cylindrical body made of a metal of which interior is dug out to be hollow, or the like may be used. As a metal material, there are iron, aluminum, and the like, and it is not particularly limited.

The conductive foamed body layer is preferably set to have a hardness in a range of 20 to 35°/500 gf in Asker C (sponge hardness meter). In addition, the resistance value is preferably in a range of $1.0\times10^{6}$ to $1.0\times10^{8}\Omega$, more preferably in a range of $1.0\times10^{7}$ to $1.0\times10^{8}\Omega$. As a matrix component, there are ethylene propylene diene rubber (EPDM), acrylonitrile butadiene rubber (NBR), and the like. The matrix component is mixed with a hydrin rubber which is added with an ion conductive agent.

The product is formed with the formed material obtained by compounding an electronic conductive agent as a resistance adjusting agent, a foaming agent, a foaming assistant, a softener, a plasticizer, a filler, a vulcanizing agent, and a vulcanizing accelerator thereto.

As the electronic conductive agent, there are carbon black, graphite, a metal oxide such as a solid solution of a zinc oxide and an aluminum oxide, a solid solution of a tin oxide and an antimony oxide, and a solid solution of an indium oxide and a tin oxide. These materials are used alone or in a combination of two or more thereof.

In addition, as the foaming agent, there are dinitrosopentamethylenetetramine (DPT), azodicarbonamide (ADCA), 4,4-oxybisbenzenesulfonyl hydrazide (OBSH), and the like, and these materials are used alone or in a combination of two or more thereof.

(Control of Transfer-Roller Applied Current and Leakage Threshold Voltage)

Figure 2:
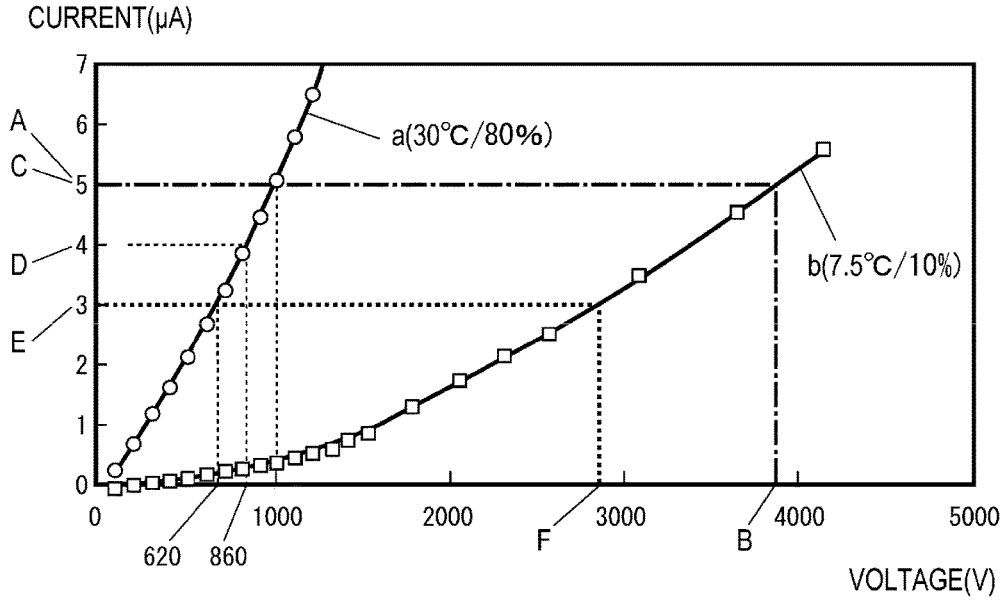
FIG. 2 is a voltage-current characteristic diagram of a transfer roller.

FIG. 2 is a voltage (V)-current (I) characteristic diagram of the transfer roller 5. Hereinafter, the control of the transfer-roller applied current and the leakage threshold voltage according to the embodiment will be described in brief with reference to the diagram.

Herein, "before image formation" denotes "before the toner image formed on the photosensitive drum 1 which is an image bearing member is transferred to the sheet 16 which is a recording medium conveyed to the transfer nip". More specifically, the "before image formation" denotes "during a preparation operation of the image formation".

The voltage-current characteristic of the transfer roller 5 is changed according to a change of temperature and humidity of the environment. A curve a plotted with circles in FIG. 2 represents the voltage-current characteristic of the transfer roller 5 in the high temperature high-humidity state (for example, 30° C./80%) where the abnormal discharge does not easily occur in the condition where the resistance value of the transfer roller and the like is lowest among the use environment conditions of the image forming apparatus S. Under the environment, the leakage occurrence and the like at the time of flowing a predetermined current to the transfer roller 5 are obtained, the threshold voltage value of the leakage occurrence is set based on the experiment result, and the threshold voltage value is stored in the memory 19 of the controller in advance. Under the high-temperature high-humidity environment (H/H), before the image formation, the CPU 20 which is a determination unit, flows a constant current of 5 μA to the transfer roller 5, and if a voltage exceeding the threshold voltage value of +860 V is not detected (for example, 0 V), the CPU determines that the abnormal discharge occurs between the transfer roller 5 and the separation charge removal needle 6 which is a separation member.

If the CPU 20 determines that the abnormal discharge occurs, the CPU decreases the current value and compares the detection result (D of FIG. 2) of the transfer high-voltage detection circuit 22 at the time of flowing a constant current of 4 μA to the transfer roller 5 with the threshold voltage value of +620 V at the time of the constant current of 4 μA in the high-temperature high-humidity (30° C./80%) environment stored in the memory 19. If the detection result does not exceed +620 V, it is determined that the abnormal discharge occurs.

If the CPU 20 determines that the abnormal discharge occurs, the CPU decreases the current value and compares the detection result (E of FIG. 2) of the transfer high-voltage detection circuit 22 at the time of flowing a constant current of 3 μA to the transfer roller 5 with the threshold voltage value of +490 V at the time of the constant current of 3 μA in the high-temperature high-humidity (30° C./80%) environment stored in the memory 19. In a case where the detected voltage value does not exceed +490 V, the apparatus interior environment is a high-temperature high-humidity environment (for example, 30° C./80%), and if the constant current of 3 μA is flowed, it is determined that the abnormal discharge occurs.

The abnormal discharge occurring in the transfer roller 5 is caused as follows. Since the separation charge removal needle 6 is arranged near the transfer roller 5, the abnormal discharge such as a leakage current flowing in a gap between the transfer roller and the separation charge removal needle occurs according to the situation of the atmospheric pressure or the temperature and humidity. Therefore, whether or not the abnormal discharge occurs is different among apparatuses because even the same units have a difference in surface shape or position thereof.

In addition, the abnormal discharge between the transfer roller 5 and the separation charge removal needle 6 more easily occurs in the low temperature environment than the high temperature environment. This is because the resistance value of the transfer roller 5 in the low temperature environment is higher than that of the high temperature environment and thus, in order to satisfy the transfer function, a higher voltage needs to be applied, so that the abnormal discharge easily occurs. In addition, similarly, with respect to the humidity, since the resistance value of the transfer roller 5 in the low humidity environment is higher than that of the high humidity environment, in order to satisfy the transfer function, a higher voltage needs to be applied, so that the abnormal discharge easily occurs.

In addition, a curve b plotted with squares in FIG. 2 represents a voltage-current characteristic curve of the transfer roller 5 in the low temperature, low humidity (in the embodiment, 7.5° C./10%) environment where the abnormal discharge easily occurs in order to increase the resistance value of the transfer roller or the like up to the highest value among the use environment conditions where the image forming apparatus S is installed.

Herein, similarly to the above-described high-temperature high-humidity environment, the current values and the leakage threshold voltage values of the transfer roller 5 in the low-temperature low-humidity environment (L/L) and the normal-temperature normal-humidity environment (N/N) (in the embodiment, 25° C./50%) are obtained through an experiment, and the current values and the threshold voltage values are stored in the memory 19 of the controller in advance (refer to FIG. 5).

(Control Flow)

Figure 3A:
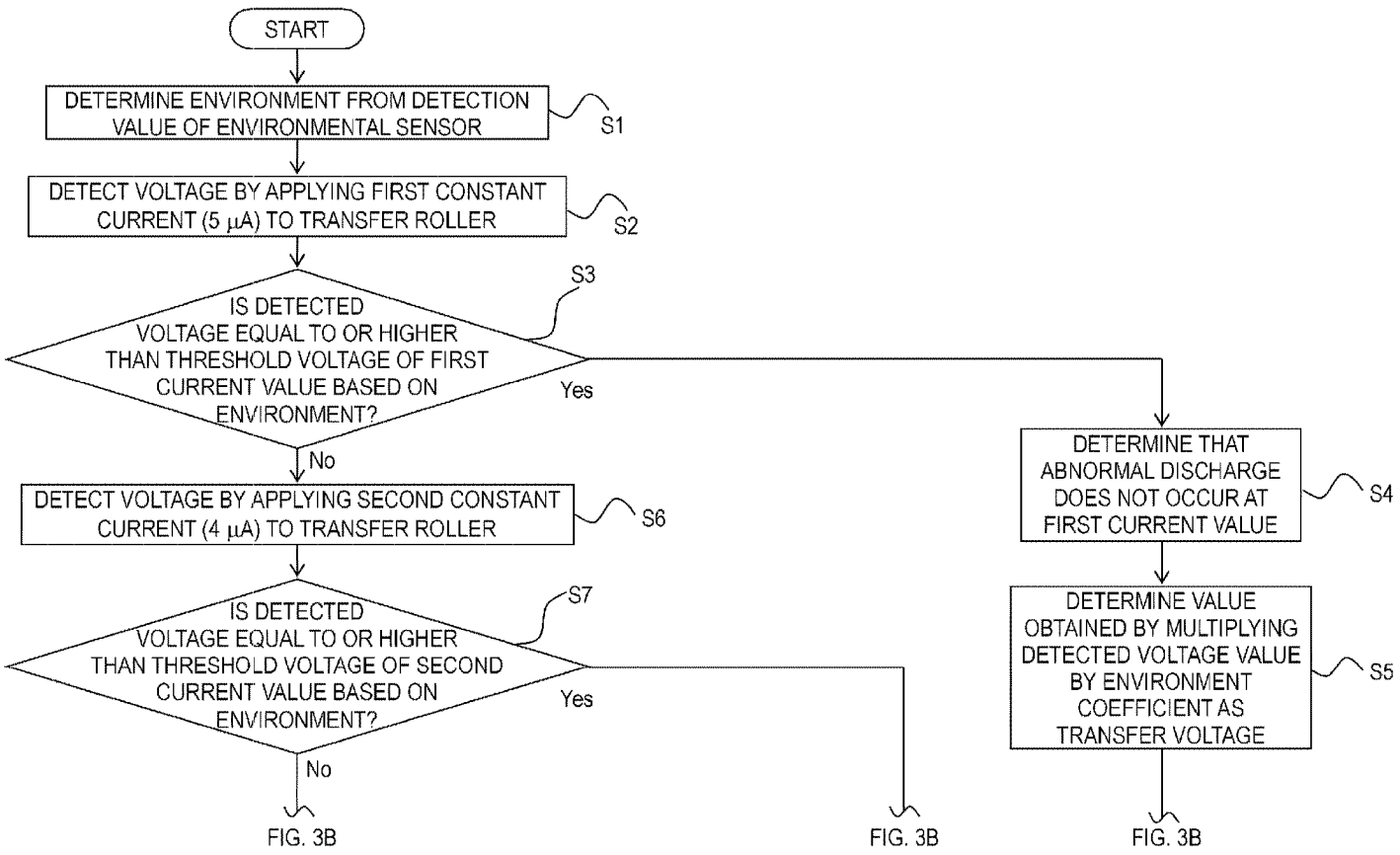
FIGS. 3A and 3B are flowcharts illustrating a control procedure of the image forming apparatus according to the first embodiment.
Figure 3B:
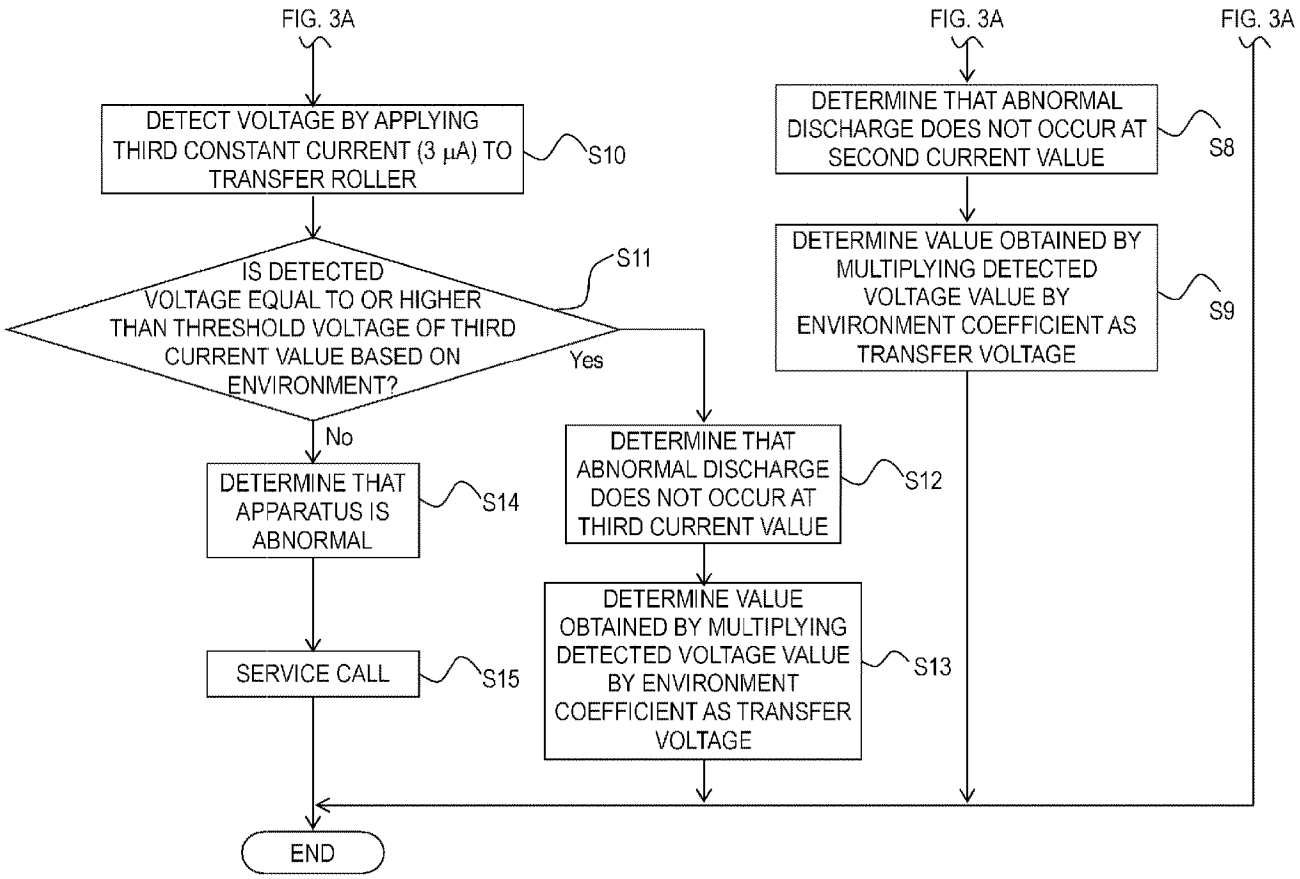

FIGS. 3A and 3B are flowcharts illustrating a control procedure of the image forming apparatus S according to the embodiment. The operations in the flowchart are executed by the CPU 20, which is a determination unit of the controller.

First, if an operator pushes a copy start button, the signal is received, a pre-rotation as an image forming preparation operation is started. The pre-rotation denotes a rotation before the image forming process of the photosensitive drum 1 accompanying various initialization operations. For example, a cleaning operation for the photosensitive drum 1, a cleaning operation for the transfer roller 5, and other various initialization operations such as supplying power to a heater in the fixing device 14 to heat the pressure roller 11 are included. In the embodiment, the environment is determined by a detection value of the environment detection sensor 18 (S1). Hereinafter, in the flowchart, it is assumed that the low-temperature low-humidity environment is detected.

In addition, as described above, under the respective environments (low-temperature low-humidity environment, normal-temperature normal-humidity environment, and high-temperature high-humidity environment), voltage values (threshold voltage values) detected when the abnormal discharge (predetermined discharge) does not occur at the time of changing the value of the constant current applied as a transfer bias are stored in the memory 19 of the controller (refer to FIG. 5).

The CPU 20 flows the constant current of 5 μA (first current value) as a bias current from a constant current circuit of the transfer high-voltage circuit 21 to the transfer roller 5 and detects the voltage at the time by using the transfer high-voltage detection circuit 22 (S2). Next, the CPU 20 compares the detected voltage with the threshold voltage value (+3300 V in the low-temperature low-humidity environment) at the time of the constant current of 5 μA stored in the memory 19 and determines whether or not the detected voltage detected in S2 exceeds +3300 V (S3).

If the detected voltage exceeds the threshold voltage value of +3300 V, it is determined that the abnormal discharge (predetermined discharge) does not occur (S4). Next, the value obtained by multiplying the environment coefficient and the value detected in S2 is determined as the transfer voltage value for the time of the image formation (S5).

In a case where the detected voltage detected in S2 is equal to or lower than the threshold voltage value of +3300 V in S3, the CPU 20 determines that the abnormal discharge (predetermined discharge) occurs due to the influence of the atmospheric pressure, and the CPU flows 4 μA (second current value) by decreasing the constant current value flowed to the transfer roller 5 by 1 μA and detects the voltage value at this time by using the transfer high-voltage detection circuit 22 (S6). The CPU 20 determines whether or not the detected voltage detected in S6 exceeds the threshold voltage value (+2700 V in the low-temperature low-humidity environment) at the time of the constant current of 4 μA stored in the memory 19 (S7).

If the detected voltage exceeds the threshold voltage value of +2700 V, the CPU 20 determines that the abnormal discharge (predetermined discharge) does not occur (S8). Next, the value obtained by multiplying the environment coefficient and the value detected in S6 is determined as the transfer voltage value for the time of the image formation (S9).

In a case where the voltage detected in S6 is equal to or lower than +2700 V, the CPU 20 determines that the abnormal discharge (predetermined discharge) occurs, and the CPU flows the constant current of 3 μA (third current value) by further decreasing the constant current value by 1 μA and detects the voltage value at this time by using the transfer high-voltage detection circuit 22 (S10). The CPU determines whether or not the detected voltage detected in S10 exceeds the threshold voltage value (+2200 V in the low-temperature low-humidity environment) at the time of the constant current of 3 μA stored in the memory 19 (S11).

If the detected voltage detected in S10 exceeds the threshold voltage value of +2200 V at the time of the constant current of 3 μA, the CPU determines that the abnormal discharge (predetermined discharge) does not occur (S12), and the value obtained by multiplying the environment coefficient and the value detected in S10 is determined as the transfer voltage value for the time of the image formation (S13). By taking into consideration the variation of the resistance value according to the sheet under the respective environments, the environment coefficient according to the respective environment is multiplied. If the detected voltage detected in S11 is equal to or lower than the threshold voltage value of +2200 V at the time of the constant current of 3 μA, the leakage due to the abnormal discharge (predetermined discharge) does not merely occur, but the current may be flowed due to the contact with the transfer roller 5, for example, according to the deformation of the shape of the separation charge removal needle 6. In this case, it is determined that the apparatus is abnormal (S14), and a service call is issued (S15).

(Effect of Control)

Next, the effect obtained by the above-described control will be described with reference to FIG. 4.

FIG. 4 illustrates, with respect to the apparatus where the embodiment is performed and apparatuses according to Examples 1 to 4 in the related art where the embodiment is not performed, the temperature (environment temperature) where the image forming apparatus is installed and good or bad image quality caused by whether or not the abnormal discharge at the temperature occurs.

As illustrated in FIG. 2, at a low environment temperature, for example, at 7.5° C., if the constant current of 5 μA is flowed to the transfer roller 5, since the resistance value of the transfer roller 5 is increased at the low temperature, the voltage value becomes +3700 V. On the contrary, at a high environment temperature, for example, 30° C., if the constant current of 5 μA is flowed to the transfer roller 5, since the resistance value of the transfer roller 5 is decreased at the high temperature, the voltage value becomes +1000 V. For this reason, if the environment temperature is increased, the abnormal discharge does not easily occur in the transfer roller 5.

As a result, as illustrated in FIG. 4, in the apparatus where the embodiment is performed, in the condition that the apparatus is at the temperature environment which is higher than 15° C., since the resistance value is low, the voltage does not easily reach the abnormal discharge occurrence voltage, and an abnormal image due to the leakage or damage to the image forming apparatus does not easily occur.

On the other hand, in the apparatus where the embodiment is performed, in the temperature environment of 7.5° C. where the resistance value is high and, thus, the abnormal discharge more easily occurs than the temperature environment of 15° C., the applied voltage for the transfer roller 5 may be optimized according to whether or not the leakage detected in the time other than the image formation period actually occurs between the transfer roller 5 and the separation charge removal needle 6. For this reason, even in the environment temperature of 7.5° C., since partially slight deterioration in image quality may be observed due to the increase in resistance value of the transfer roller 5, it may be stated that there is almost no abnormality in image quality. In addition, even in a case where the environment temperature is changed from 7.5° to 15° C. due to the change in season, by performing the controlling of the transfer-roller applied current according to the embodiment, it is possible to allow the apparatus to automatically maintain the good image quality without intervention of an operator.

On the other hand, in the apparatus of Example 1 of the related art where any measures to the abnormal discharge are not taken, an abnormal image or damage to the apparatus occurs due to the abnormal discharge in the condition of 7.5° C. In addition, even in a case where the environment temperature is changed from 7.5° C. to 15° C., an abnormal image or damage to the apparatus occurs.

Example 2 of the related art is an "apparatus which avoids the abnormal discharge from a detection result of an atmospheric pressure". In this apparatus, since the control is changed according to the level of the atmospheric pressure, even in the condition that the environment temperature is high and the resistance value of the transfer roller 5 is low, so that the abnormal discharge does not occur, under the environment where the atmospheric pressure is low, the control of avoiding the abnormal discharge is performed so as to decrease the transfer voltage. For this reason, the example cannot cope with the temperature of 15° C. where the abnormal discharge does not easily occur and a case where the temperature is changed from the temperature of 7.5° C. where the abnormal discharge easily occurs to the temperature of 15° C. where the abnormal discharge does not easily occur. In the example, it is determined based on only the atmospheric pressure that the abnormal discharge easily occurs, so that deterioration in image quality (transfer failure) occurs.

Example 3 of the related art is an "apparatus where a leakage detection circuit is added to a high-voltage board to detect the abnormal discharge". In this apparatus, if the shapes of distal ends of individual electrodes, distances between electrodes, applied voltages, or the like are different, the degree of easiness of occurrence of the abnormal discharge is different, and thus, in many cases, the abnormal discharge cannot be accurately detected. Therefore, in the apparatus of Example 3 of the related art, even in the condition that the leakage detection circuit does not detect the abnormal discharge, the abnormal discharge occurs between the transfer roller 5 and the separation charge removal needle 6, so that deterioration in image quality (transfer failure) may occur.

On the contrary, in the apparatus of Example 3 of the related art, even in a case where the abnormal discharge does not occur between the transfer roller 5 and the separation charge removal needle 6, the control of avoiding discharge is performed by allowing the leakage detection circuit to determine that the abnormal discharge occurs, and thus, deterioration in image quality may occur due to a shortage of the transfer current. Actually, as illustrated in Example 3 of the related art in FIG. 4, deterioration in image quality occurs under all the conditions.

Example 4 of the related art is an "apparatus where a service man manually sets up a pressure reduction mode". In this apparatus, in a case where the image forming apparatus S is installed in a high-altitude area where the atmospheric pressure is low and, thus, the abnormal image occurs, the control (pressure reduction mode) of avoiding the abnormal discharge is manually set up. In this case, even in a case where the environment condition is changed due to the change in season to the condition where the abnormal discharge does not occur (for example, a case where the environment temperature is changed from 7.5° C. to 15° C.), if the pressure reduction mode is not released by the service man's manually setting up, an unnecessary deterioration in image quality (transfer failure) may occur.

Therefore, in this condition, as long as the service man does not repetitively set up or release the pressure reduction mode according to the change in air temperature, it is not possible to prevent the unnecessary deterioration in image quality. Example 4 of the related art in FIG. 4 represents that, if a change in air temperature occurs, as long as the service man does not appropriately set up, deterioration in image quality occurs.

Contrary to Examples 1 to 4 of the related art described heretofore, in the apparatus according to the embodiment, in a high-altitude area where the atmospheric pressure is low and there is a change in air temperature, without an operator such as a service man repetitively performing setting up or releasing the control (pressure reduction mode) of avoiding the abnormal discharge (predetermined discharge) which occurs due to the low atmospheric pressure, it is possible to prevent the occurrence of an unnecessary deterioration in image quality. In addition, when the abnormal discharge (predetermined discharge) occurs, it is possible to detect whether or not the abnormal discharge actually occurs between image forming components associated with the abnormal image (between the transfer roller and the separation charge removal needle or the like). Accordingly, without influence of the atmospheric pressure, it is possible to perform accurate detection according to a change in air temperature, so that it is possible to prevent the occurrence of deterioration in image quality (transfer failure).

In this manner, in the apparatus according to the embodiment, during a preparation operation before the image formation, by changing and flowing a transfer bias, a voltage where abnormal discharge is started is detected, and a voltage lower than the voltage where the abnormal discharge is started may be applied. For this reason, an appropriate applied voltage may be used without intervention of an operator while avoiding deterioration in image quality or damage to an electric element caused by the abnormal discharge, and it is possible to suppress transfer failure easily.

In addition, in the above-described embodiment, the voltage value detected when the transfer high-voltage circuit 21 flows a constant current is compared with the threshold voltage value of each environment, and the transfer voltage value applied in the image formation is determined. However, alternatively, a constant voltage circuit applies a constant voltage to the transfer roller 5, a current value flowed at this time is detected, and the determination unit compares the detected current value with a current value (threshold current value) flowing when the abnormal discharge of each environment does not occur, determines whether predetermined discharge occurs in the transfer unit.

In addition, instead of the environment detection sensor 18, an atmospheric pressure sensor may be arranged as the environment detection sensor. In a case where the transfer current is flowed based on an atmospheric pressure detected by the atmospheric pressure sensor, a threshold voltage where the abnormal discharge does not occur is defined in advance, and the threshold voltage at the atmospheric pressure is selected based on the atmospheric pressure detected by the atmospheric pressure sensor, so that the occurrence of the abnormal discharge may be determined.

In addition, in the embodiment, a DC voltage having a polarity opposite to that of the developer is applied from the transfer high-voltage circuit 21 of the high-voltage power supply unit to the transfer roller 5. However, the voltage applied to the transfer roller 5 is not limited to the DC voltage, but an AC voltage or a superposition of a DC voltage and an AC voltage may be applied.

Furthermore, in the embodiment, the occurrence of the abnormal discharge is determined based on the voltage value or the current value detected by the above-described detection unit, and in a case where the abnormal discharge occurs, the applied voltage value is allowed to be decreased. However, on the contrary, in a case where the occurrence of the abnormal discharge is not observed, the voltage value applied to the transfer roller 5 is allowed to be increased until the occurrence of the abnormal discharge is observed, and at a range where the occurrence of the abnormal discharge is not observed, the current value or the voltage value of the transfer unit at the time of the image formation may be determined. By increasing the voltage value, it is possible to improve the transfer function.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-112731, filed May 30, 2014, and No. 2015-101487 filed May 19, 2015, which are hereby incorporated by reference herein in their entirety.

What is claimed is:

1. An image forming apparatus, comprising:

a first image bearing member which bears a toner image;

a transfer unit which transfers the toner image borne by the first image bearing member to a second image bearing member;

an applying unit which applies a current or voltage to the transfer unit for transferring the toner image to the second image bearing member;

a detection unit which detects a voltage value at a time that the applying unit applies predetermined current to the transfer unit;

an environment unit which detects an environment condition; and a determination unit which has a plurality of threshold voltage values and determines a selected threshold voltage value selected from the plurality of threshold voltage values based on a detection result of the environment unit, wherein the determination unit determines that predetermined discharge occurs when a detection voltage value detected by the detection unit is equal to or less than the selected threshold voltage value and that the predetermined discharge does not occur when the detection voltage value is greater than the selected threshold voltage value.

2. The image forming apparatus according to claim 1, wherein the environment unit is a temperature-humidity sensor which detects temperature and humidity or an atmospheric pressure sensor which detects atmospheric pressure.

3. The image forming apparatus according to claim 1, wherein in a case where the determination unit determines that the predetermined discharge occurs, the determination unit changes the predetermined current to a second current value which is decreased from a value of the predetermined current supplied by the applying unit.

4. The image forming apparatus according to claim 3, wherein in a case where the detection voltage value exceeds the selected threshold voltage value by supplying the second current value, the determination unit determines a voltage value applied by the applying unit to the transfer unit at a time of image formation based on the detection voltage value detected by the detection unit when the second current value is applied to the transfer unit at an image transferring period to transfer the toner image from the first image bearing member to the second image bearing member.

5. The image forming apparatus according to claim 1, wherein in a case where the determination unit does not determine that the predetermined discharge occurs, the applying unit applies a voltage value to the transfer unit based on the detection voltage value detected by the detection unit at an image transferring period transferring the toner image from the first image bearing member to the second image bearing member.

6. The image forming apparatus according to claim 1, wherein in a case where the determination unit determines that the predetermined discharge does not occur, the determination unit changes the predetermined current to a second current value which is increased from a value of the predetermined current supplied by the applying unit, and when the detection voltage value exceeds the selected threshold voltage value by supplying the second current value, the determination unit determines a voltage value applied by the applying unit to the transfer unit at a time of image formation based on the detection voltage value detected by the detection unit when the second current value is applied to the transfer unit at an image transferring period to transfer the toner image from the first image bearing member to the second image bearing member.

7. An image forming apparatus, comprising:

a first image bearing member which bears a toner image;

a transfer unit which transfers the toner image borne by the first image bearing member to a second image bearing member;

an applying unit which applies a voltage to the transfer unit at an image transferring period to transfer the toner image from the first image bearing member to the second image bearing member;

a detection unit which detects a voltage value when the applying unit supplies a predetermined current value;

an environment unit which detects an environment condition; and a determination unit which has a plurality of threshold voltage values and determines a selected threshold voltage value selected from the plurality of threshold voltage values based on a detection result of the environment unit, wherein in a case where the voltage value detected by the detection unit exceeds the selected threshold voltage value, the determination unit determines the voltage value applied to the transfer unit at the image transferring period based on the voltage value detected by the detection unit when the predetermined current value is supplied to the transfer unit, and wherein in a case that the voltage value detected by the detection unit is less than the selected threshold voltage value, the determination unit determines the voltage applied to the transfer unit at the image transferring period based on the voltage value detected by the detection unit when the predetermined current value is changed to a second current value and the voltage value exceeds the selected threshold voltage value when the second current value is supplied to the transfer unit.

8. The image forming apparatus according to claim 7, wherein the environment unit is a temperature humidity sensor which detects temperature and humidity or an atmospheric pressure sensor which detects atmospheric pressure.

9. The image forming apparatus according to claim 7, wherein the second current value is less than the predetermined current value.

10. The image forming apparatus according to claim 7, wherein in a case where the voltage value detected by the detection unit exceeds the selected threshold voltage value, the determination unit determines a voltage value applied by the applying unit to the transfer unit at the image transferring period based on a result detected by the environment unit and the voltage value detected by the detection unit.

11. The image forming apparatus according to claim 7, wherein in a case where the current value is changed to a third current value which is less than the predetermined current value and greater than the second current value and the voltage value detected by the detection unit exceeds the selected threshold voltage value, the determination unit determines the voltage value applied to the transfer unit at the image transferring period based on the voltage value detected by the detection unit when the third current value is supplied to the transfer unit.

* * * * *